United States Patent [19]

Kulischenko

[11] 4,244,316

[45] Jan. 13, 1981

[54] MARINE VESSEL SAFEGUARD STEERING MECHANISM

[75] Inventor: Walter Kulischenko, East Brunswick, N.J.

[73] Assignee: Pennwalt Corporation, Philadelphia, Pa.

[21] Appl. No.: 15,830

[22] Filed: Feb. 28, 1979

[51] Int. Cl.[3] ..... B63H 25/00

[52] U.S. Cl. ..... 114/144 R; 74/509

[58] Field of Search ..... 114/144 R; 115/35, 18 R; 74/479, 480 R, 480 B, 508, 509, 501 R; 280/771; 180/145

[56] References Cited

U.S. PATENT DOCUMENTS

| | | | |
|---|---|---|---|
| 2,968,189 | 1/1961 | Walko | 74/496 |
| 3,111,042 | 11/1963 | Hoover | 115/18 R |

*Primary Examiner*—Trygve M. Blix
*Assistant Examiner*—Jesus D. Sotelo

[57] ABSTRACT

Steering mechanism utilizes a pair of serially connected pulley-belt systems having a stepped-up output which causes a flexible shaft to rotate in the remote steering of a marine vessel. Upon fracture of a belt and/or when travelling at high speeds, the safeguard mechanism permits a rapid changeover to a direct drive steering capability such that steering shaft rotation is transmitted directly to the output shaft which rotates the flexible shaft.

5 Claims, 5 Drawing Figures

MARINE VESSEL SAFEGUARD STEERING MECHANISM

CROSS-REFERENCE TO OTHER RELATED PATENT APPLICATIONS

Reference is hereby made to copending application of W. Kulischenko et al. for "Remotely Actuated Marine Steering System," Ser. No. 880,410, filed Feb. 23, 1978, now U.S. Pat. No. 4,173,937, assigned to the present assignee.

STATEMENT OF THE INVENTION

This invention relates to remotely controlled marine steering systems and more particularly to a safeguard steering device which permits conversion to a direct drive steering system upon failure of the normal steering mechanism, or when travelling at high speeds.

BACKGROUND AND SUMMARY OF THE INVENTION

Marine steering systems employing remotely actuated rotatable flexible shafts are known. These flexible means are basic elements of power transmission and are designed to transmit power or control from a driving element to an element to be driven, where direct coupling therebetween is impractical.

In known prior art marine steering systems of the class covered by this invention, the driving element is an output shaft of a device which has been appropriately "stepped-up" by suitable gearing mechanism. The stepped-up output is then fed into a rotatable flexible shaft. The driven element is usually a device which is capable of converting rotary motion from the rotatable flexible shaft to linear motion, and may comprise a ball screw cylinder, threaded screw, or the like. The linear motion is transmitted to a convenient output member which operates or controls the rudder or other steering mechanism. Such gear mechanisms are not smooth in operation, provide undesirable backlash, and are somewhat noisy even when made from suitable nonmetallic materials.

In the cross-referenced patent application, now U.S. Pat. No. 4,173,937, a pulley belt-rotatable flexible shaft device is employed which minimizes the aforementioned undesirable characteristics associated with gear mechanisms used in marine steering applications.

The present invention provides a safeguard device for use with such marine steering systems employing pulley-belt-rotatable flexible shaft means and permits immediate direct drive steering capability upon fracture of the belt means. Additionally, the present safeguard device will permit the operator of the vessel to switch to direct drive steering at high speeds of travel to thus minimize the dangers of oversteering. The changeover to direct drive is readily achieved by a simple manual operation and is available to the operator at any speed of travel of the marine vessel.

DETAILED DESCRIPTION OF THE INVENTION

Figure 1:
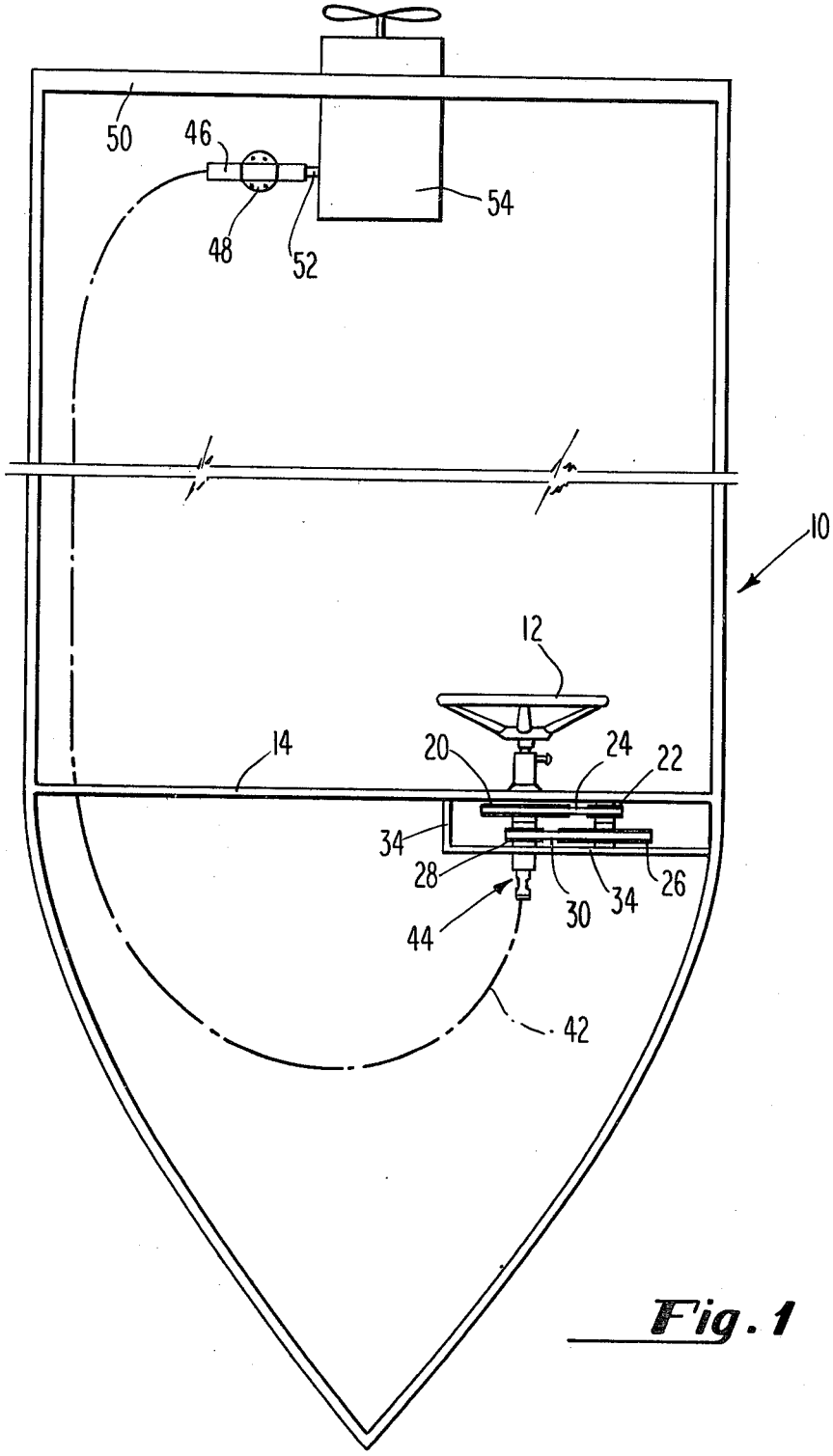
FIG. 1 is a diagrammatic plan view of a marine vessel employing the safeguard steering mechanism of the present invention.
Figure 2:
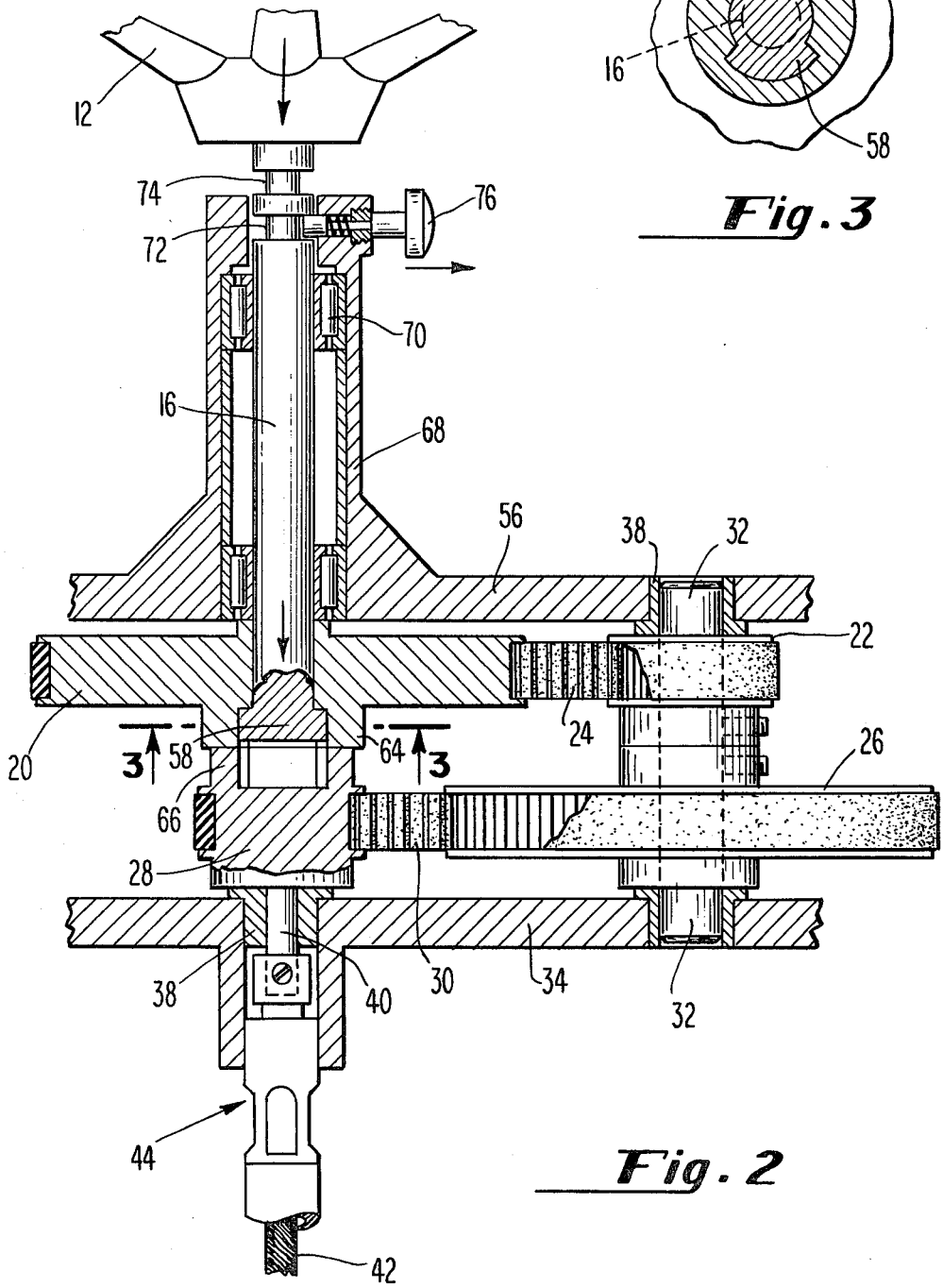
FIG. 2 is a longitudinal sectional view of the present steering mechanism when operating under normal steering conditions.
Figure 3:
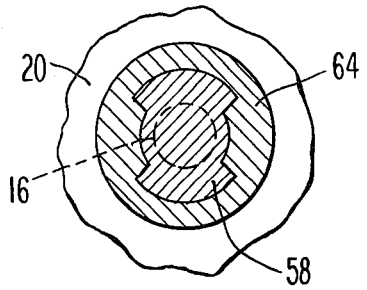
FIG. 3 is a sectional view taken along line 3—3 of the embodiment of FIG. 2.
Figure 5:
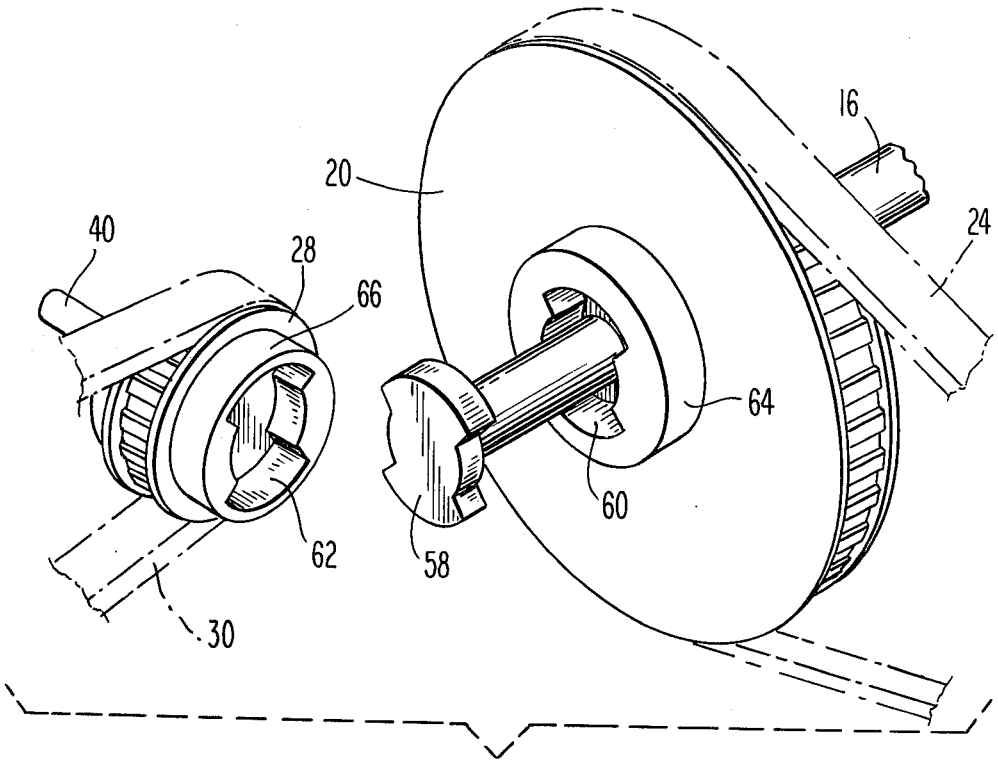
FIG. 5 is a perspective view of several components of the present safeguard steering mechanism, the components being disassembled and then rotated for clarity.

In FIGS. 1 and 2, a boat or vessel 10 employs a manually operable steering wheel 12 which may be mounted through dashboard 14. A steering shaft 16 and a driver pulley 20 are releasably keyed, to be described hereinafter. When keyed, one revolution of steering wheel 12 produces a similar revolution of driver pulley 20. Rotation of driver pulley 20 causes driven pulley 22 to rotate therewith by virtue of a timing belt 24 operably engaged therebetween. Driven pulley 22 is provided with a smaller diameter than driver pulley 20, and thus, a single revolution of driver pulley 20 will produce a plurality of revolutions of the driven pulley. Driver pulley 20, driven pulley 22 and timing belt 24 comprise a first pair of pulley-belt systems.

A second pair of such systems comprises driver pulley 26, driven pulley 28 and timing belt 30, the second pair being additively or serially connected to the first pair through shaft 32, interconnecting driven pulley 22 of the first pair and driver pulley 26 of the second pair. In the present invention, one complete revolution of steering wheel 12, or driver pulley 20, will cause 3 revolutions of driven pulley 22, which in turn causes a like number of revolutions of driver pulley 26 which then rotates driven pulley 28 a total of 6 revolutions. The ratio of diameters of the pulleys to achieve these values is readily calculable and is not stated herein. Each of the pulleys may be journalled or rotatably mounted to their respective support members by suitable bearing members 38.

Driven pulley 28 is rotatably and supportably mounted to housing 34 by means of a pulley shaft 40 which is aligned with steering shaft 16. Pulley shaft 40 communicates with rotatable flexible shaft 42 through a conventional flexible shaft end fitting assembly 44. Thus, torque from pulley shaft 40 is transmitted to flexible shaft 42, the torque therefrom being transmitted to a ball screw cylinder 46, secured by brackets 48 to boat 10 adjacent transom 50.

Ball screw cylinder 46 is conventional and converts rotary motion from flexible shaft 42 to linear motion, which linear motion is transmitted to an output member 52 for controlling a steering arm (not shown) on motor 54. The steering arm moves motor 54 or a rudder or other steering member by conventional means.

Both pairs of pulley-belt systems above described may readily, and preferably will be enclosed in a self-contained unit (FIG. 2) having means for supporting steering shaft 16 through a front panel member 56 of housing 34 of the unit. The self-contained unit (including steering wheel 12) will be conveniently affixed to, or mounted through dashboard 14.

Referring now to FIGS. 2 through 5, the safeguard steering system of the present invention includes a clutch device which permits the operator to employ a direct drive steering capability in the event either or both belts 24 or 30 fracture, or when boat 10 is travelling at high speeds. Under either or both conditions, it is desirable, if not essential, that steering capability be maintained.

Direct drive steering is obtained when rotation of steering shaft 16 causes pulley shaft 40 to rotate in direct accordance therewith, later described. It is apparent therefore that either or both belts 24 or 30 will be fractured, and/or pulley 20 will not be caused to rotate when steering shaft 16 is rotated. To clarify, a non-circular key member 58 is integrally fabricated to an outer end of steering shaft 16 as shown in the drawings, or alternatively may be mounted thereto. Key 58 is engageable with mating keyways 60 and 62 provided in central flanged portions 64 and 66 of pulleys 20 and 28 respectively. When key 58 is engaged within keyway 62 of pulley 28, it is apparent that pulley 20 will rotate freely on steering shaft 16. Under such conditions of engagement between key 58 and keyway 62, regardless of the integrity of the belts, the operator may be considered as steering under direct drive conditions. For purposes of this invention, a high speed may be defined as any speed under given water and weather conditions where a skilled operator would feel safer or in better steering control if direct drive were employed, normally 40 to 50 mph., and above, as for example, under racing conditions.

Figure 4:
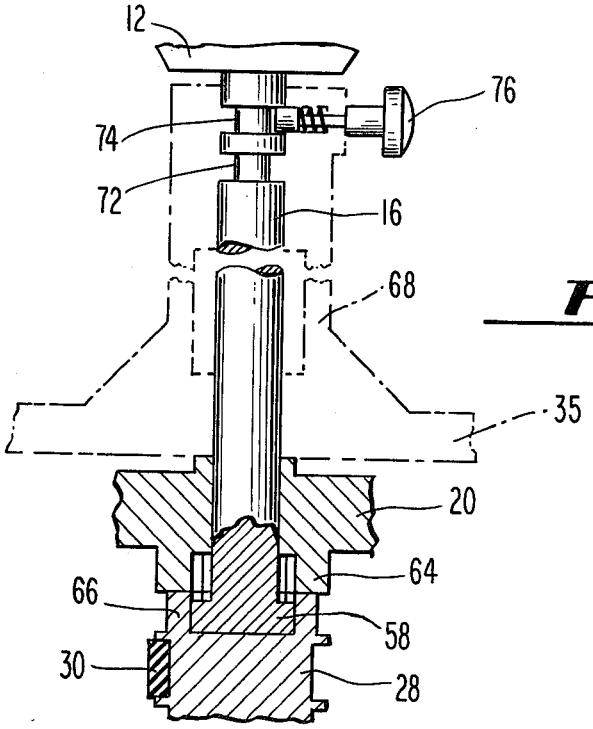
FIG. 4 is a fragmented sectional view, partially in phantom, of a portion of the embodiment of FIG. 2 when the steering mechanism is operating in direct drive.

Dashboard 14, or the front panel plate 56 of housing 34 if a self-contained unit is employed, is provided with hub 68 through which steering shaft 16 is rotatably mounted by means of suitable bearings 70. A pair of spaced grooved annuli 72 and 74 is provided around steering shaft 16 beneath hub 68. A spring-loaded pin 76 penetrates hub 68 to engage groove 72 under normal steering conditions. When direct drive steering is to be employed, pin 76 will be disengaged from groove 72 with one hand while the other hand merely pushes down or forward on steering wheel 12, approximately $\frac{1}{2}$ to $\frac{3}{4}''$ in practice, until pin 76 engages groove 74 as illustrated in FIG. 4 of the drawings, which automatically causes key 58 to disengage itself from keyway 60 and to then engage keyway 62. The operator may be required to rotate steering wheel 12 until engagement with keyway 62 is achieved. It will be understood, of course, that key 58 and its mating keyways may be so configured that automatic engagement therebetween is provided, such other configurations being within the intended scope of the present invention.

Similarly, the clutch may be a rudimentary pin type mechanism, for example, wherein a male member is provided with a plurality of pins extending therefrom, which pins are received by corresponding holes disposed in a female member. Or, intermeshing toothed members, beveled or not, may be used advantageously with the present invention to provide automatic engagement of the clutch members.

Other types of mechanisms may be employed, as a push-pull rod disposed within a hollow steering shaft for control of the clutch mechanism; a snap-type cam pin may be used in lieu of pin 76; three or more pulley-belt systems may be used; and the like.

I claim:

1. In a marine vessel steering system wherein manually-operable steering control means effects rotation of rotatable flexible means for controlling movement of a steering member through screw means which converts rotary motion from said rotatable flexible means to linear motion, said linear motion effecting movement of said steering member which controls direction of travel of said marine vessel, said steering control means having a steering shaft affixed thereto for rotation therewith, the combination of a safeguard improvement thereto comprising a first pair and a second pair of serially connected driver pulley-driven pulley-belt systems, interengaging means provided on said steering shaft and driver pulley of said first pair of systems for releasable disengagement therebetween, a pulley shaft aligned with said steering shaft, said pulley shaft fixedly secured to a driven pulley of said second pair of systems, said pairs of systems being so arranged that a single revolution of said steering shaft causes a plurality of revolutions of said driven pulley of said second pair of systems, said rotatable flexible means communicating with an output end of said pulley shaft, means for interlocking said steering and pulley shafts while simultaneously disengaging said steering shaft from said interengaging means upon fracture of any of said belts of said driver pulley-driven pulley-belt systems or high speed travel of said marine vessel whereby rotation of said steering means rotates said driven pulley of said second pair of systems in accordance therewith.

2. The marine vessel steering system of claim 1 wherein said interengaging means is characterized by said driver pulley of said first pair of systems being provided with an axially aligned non-circular recess at an outer surface thereof, a non-circular key affixed to an outer end of said steering shaft, said key being engageable with said noncircular recess to form engaging members, and means cooperating with said interengaging means for disengaging said engaging members.

3. The marine vessel steering system of claim 2 wherein said interlocking means includes said driven pulley of said second pair of systems being provided with an axially aligned noncircular recess at an inner surface thereof engageable with said key to form interlocking member, and said means cooperating with said interengaging means also cooperating with said interlocking means for disengaging said engaging members while substantially simultaneously therewith engaging said interlocking members.

4. The marine vessel steering system of claim 3 wherein said means cooperating with said interengaging and interlocking means comprises spring release means disposed adjacent said steering control means for permitting said engaging members to become disengaged upon an inward movement of said steering control means while substantially simultaneously interlocking said interlocking members.

5. The marine steering system of claim 4 further characterized by each of said non-circular recesses being disposed in a central flange provided on each of facing surfaces of said driver and driven pulleys of said first and second pairs of systems respectively.

* * * * *